US008109252B2

(12) United States Patent
Watkins et al.

(10) Patent No.: US 8,109,252 B2
(45) Date of Patent: Feb. 7, 2012

(54) ROTARY ENGINE COMBUSTION CHAMBER

(75) Inventors: Barton W. Watkins, Knoxville, TN (US); Lawrence A. Hendrix, Knoxville, TN (US)

(73) Assignee: Power Source Technologies, Inc., Knoxville, TN (US)

( * ) Notice: Subject to any disclaimer, the term of this patent is extended or adjusted under 35 U.S.C. 154(b) by 752 days.

(21) Appl. No.: 12/110,061

(22) Filed: Apr. 25, 2008

(65) Prior Publication Data

US 2008/0267805 A1 Oct. 30, 2008

Related U.S. Application Data

(60) Provisional application No. 60/914,444, filed on Apr. 27, 2007.

(51) Int. Cl.

| | |
|---|---|
| ***F02B 53/00*** | (2006.01) |
| ***F02B 53/10*** | (2006.01) |
| ***F01C 1/02*** | (2006.01) |
| ***F01C 1/063*** | (2006.01) |
| ***F01C 1/00*** | (2006.01) |
| ***F04C 18/00*** | (2006.01) |
| ***F04C 2/00*** | (2006.01) |

(52) U.S. Cl. ..... 123/241; 123/246; 123/205; 418/61.2; 418/227; 418/225

(58) Field of Classification Search ..... 123/241, 123/246, 229, 232, 205; 418/61.2, 227, 225
See application file for complete search history.

(56) References Cited

U.S. PATENT DOCUMENTS

| | | | | | |
|---|---|---|---|---|---|
| 525,121 | A | * | 8/1894 | Shepard | 418/225 |
| 2,863,425 | A | * | 12/1958 | Breelle | 123/232 |
| 2,920,814 | A | * | 1/1960 | Breelle | 123/232 |
| 3,196,848 | A | * | 7/1965 | Bensinger | 418/61.2 |
| 3,249,095 | A | * | 5/1966 | Hamada | 123/205 |
| 3,297,005 | A | * | 1/1967 | Lamm | 418/61.2 |
| 3,584,607 | A | * | 6/1971 | Yamamoto | 418/61.2 |
| 3,606,602 | A | | 9/1971 | Hamada et al. | 418/61.2 |
| 3,696,796 | A | * | 10/1972 | Gavrun | 123/205 |
| 3,716,989 | A | * | 2/1973 | Moreira | 123/229 |
| 3,739,753 | A | * | 6/1973 | Burley et al. | 123/210 |
| 3,782,341 | A | | 1/1974 | Eells | 123/241 |

(Continued)

OTHER PUBLICATIONS

International Search Report and Written Opinion for PCT Application No. PCT/US2008/061629 with a mailing date of Aug. 11, 2008.

*Primary Examiner* — Thai Ba Trieu
(74) *Attorney, Agent, or Firm* — Knox Patents; Thomas A. Kulaga

(57) ABSTRACT

An apparatus for facilitating combustion in a rotary engine with planetary rotors orbiting inside a housing containing a main rotor. In various embodiments, the planetary rotor has a multi-faceted face that engages a bridge during the transition from the compression cycle to the combustion cycle with the bridge and face forming a dynamic seal; the planetary rotor has a face engaging a bridge during the transition from the compression cycle to the combustion cycle such that the bridge and face have a gap that allows gas flow from the trailing volume to the leading volume and the gap is sufficiently small to quench flame propagation from the leading volume to the trailing volume; and/or the face of the planetary rotor opposite a fuel injector has a pocket that allows the fuel cloud to expand without impinging or wetting the face of the planetary rotor.

15 Claims, 12 Drawing Sheets

U.S. PATENT DOCUMENTS

| | | | | | |
|---|---|---|---|---|---|
| 3,820,513 | A | * | 6/1974 | Buettner | 123/229 |
| 3,929,106 | A | | 12/1975 | Scott | 123/205 |
| 3,976,035 | A | * | 8/1976 | Mitchell | 123/205 |
| 4,023,535 | A | * | 5/1977 | Ishikawa | 123/219 |
| 4,085,712 | A | | 4/1978 | Myers et al. | 123/205 |
| 4,100,911 | A | | 7/1978 | Kromer | 123/205 |
| 4,793,304 | A | * | 12/1988 | Eiermann | 123/205 |
| 6,932,047 | B2 | | 8/2005 | Watkins et al. | 123/241 |
| 7,044,102 | B2 | | 5/2006 | Watkins et al. | 123/241 |
| 7,350,501 | B2 | | 4/2008 | Watkins et al. | 123/241 |
| 7,500,461 | B2 | * | 3/2009 | Baier et al. | 123/205 |
| 2006/0191510 | A1 | | 8/2006 | Watkins et al. | |
| 2007/0119408 | A1 | * | 5/2007 | Kang | 123/232 |
| 2008/0029059 | A1 | * | 2/2008 | Isbrecht | 123/203 |
| 2008/0141972 | A1 | * | 6/2008 | Morrison et al. | 123/200 |

* cited by examiner

ROTARY ENGINE COMBUSTION CHAMBER

CROSS-REFERENCE TO RELATED APPLICATIONS

This application claims the benefit of U.S. Provisional Application No. 60/914,444, filed Apr. 27, 2007.

STATEMENT REGARDING FEDERALLY SPONSORED RESEARCH OR DEVELOPMENT

Not Applicable

BACKGROUND OF THE INVENTION

1. Field of Invention

This invention pertains to a rotary engine with multiple planetary rotors orbiting inside the engine housing. More particularly, this invention pertains to facilitating combustion in such a rotary engine.

2. Description of the Related Art

One type of rotary engine has a main rotor with circular cutouts. Inside each circular cutout is a planetary rotor that orbits the center of rotation of the main rotor. The planetary rotor has faces that sequentially cycle through intake, compression, combustion, and exhaust. Such rotary engines are disclosed in U.S. Pat. Nos. 6,932,047; 7,044,102; 7,350,501; and in patent application Ser. No. 12/041,753, hereby all incorporated by reference. Other rotary engines include those such as the Wankel engine. These engines operate with a different configuration than described herein and experience different problems. In particular, the Wankel-type engines operate with a rotor mounted on an eccentric with the rotor moving within a two-lobed cavity.

The compression and combustion cycles occur sequentially as a face of the planetary rotor passes through top dead center (TDC). At TDC, a face of the planetary rotor defines a trailing volume and a leading volume, with the two volumes divided by a bridge protruding from the housing. The trailing volume contains the compressed gas from the compression cycle. The leading volume becomes the combustion chamber as the planetary rotor continues its orbit past TDC. Isolating the trailing and leading volumes when the planetary rotor passes TDC is difficult.

In order to ensure complete and efficient combustion, it is known to introduce turbulence in the fuel air mixture in a combustion chamber. The configuration of the rotary engine is such that difficulties are encountered in attempting to maintain isolation when needed and to also introduce turbulence when desired.

In the rotary engine, it is desirable to introduce or inject fuel near TDC. At this position, the leading volume is small because of the proximity of the planetary rotor face and the engine housing. It is desirable to keep the leading volume small at the beginning of the combustion cycle and it is desirable to avoid having the injected fuel impinge upon or wet the face of the planetary rotor.

BRIEF SUMMARY OF THE INVENTION

According to one embodiment of the present invention, a planetary rotor has a multi-faceted face that engages a bridge during the transition from the compression cycle to the combustion cycle with the bridge and face forming a dynamic seal. In this way, the trailing volume is isolated from the leading volume as the face of the planetary rotor passes through top dead center (TDC).

In one such embodiment, the planetary rotor face has at least two sections. The first, leading section is an arcuate surface that provides clearance between the rotor face and the trailing edge of the bridge as the planetary rotor orbits in the rotary engine. The second, mid-section is adjacent the bridge with the planetary rotor near TDC and maintains an air gap sufficiently small to form a dynamic seal.

According to another embodiment of the present invention, a planetary rotor has a face engaging a bridge during the transition from the compression cycle to the combustion cycle such that the bridge and face have a gap that allows gas flow from the trailing volume to the leading volume and the gap is sufficiently small to quench flame propagation from the leading volume to the trailing volume. In this way, turbulence is introduced into the leading volume of a rotary engine during the period that the fuel is introduced into the leading volume without encouraging flame propagation from the leading volume to the trailing volume.

In one such embodiment, the face of the planetary rotor has channels or grooves positioned to increase gas flow during selected portions of the combustion cycle, with the channels or grooves facilitating turbulence in the leading volume by allowing compressed gas from the trailing volume to flow into the leading volume.

According to another embodiment of the present invention, the face of the planetary rotor opposite a fuel injector has a pocket. In this way, the fuel cloud is able to expand without impinging or wetting the face of the planetary rotor. In one such embodiment, the pocket has a configuration and shape to accommodate the fanning of the injected fuel as the planetary rotor orbits past the injector. The shape avoids wetting the face of the planetary rotor and the surface of the pocket.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An apparatus for facilitating combustion in a rotary internal combustion engine 100 is disclosed. The illustrated engine 100 is a planetary piston rotary engine, such as that disclosed in U.S. Pat. Nos. 6,932,047 and 7,044,102, and in patent application Ser. No. 11/382,972, all incorporated by reference. In various embodiments, the rotary internal combustion engine 100 includes either compression ignition or spark ignition and includes fuel injection or other forms of introducing fuel into the engine 100.

Figure 1:
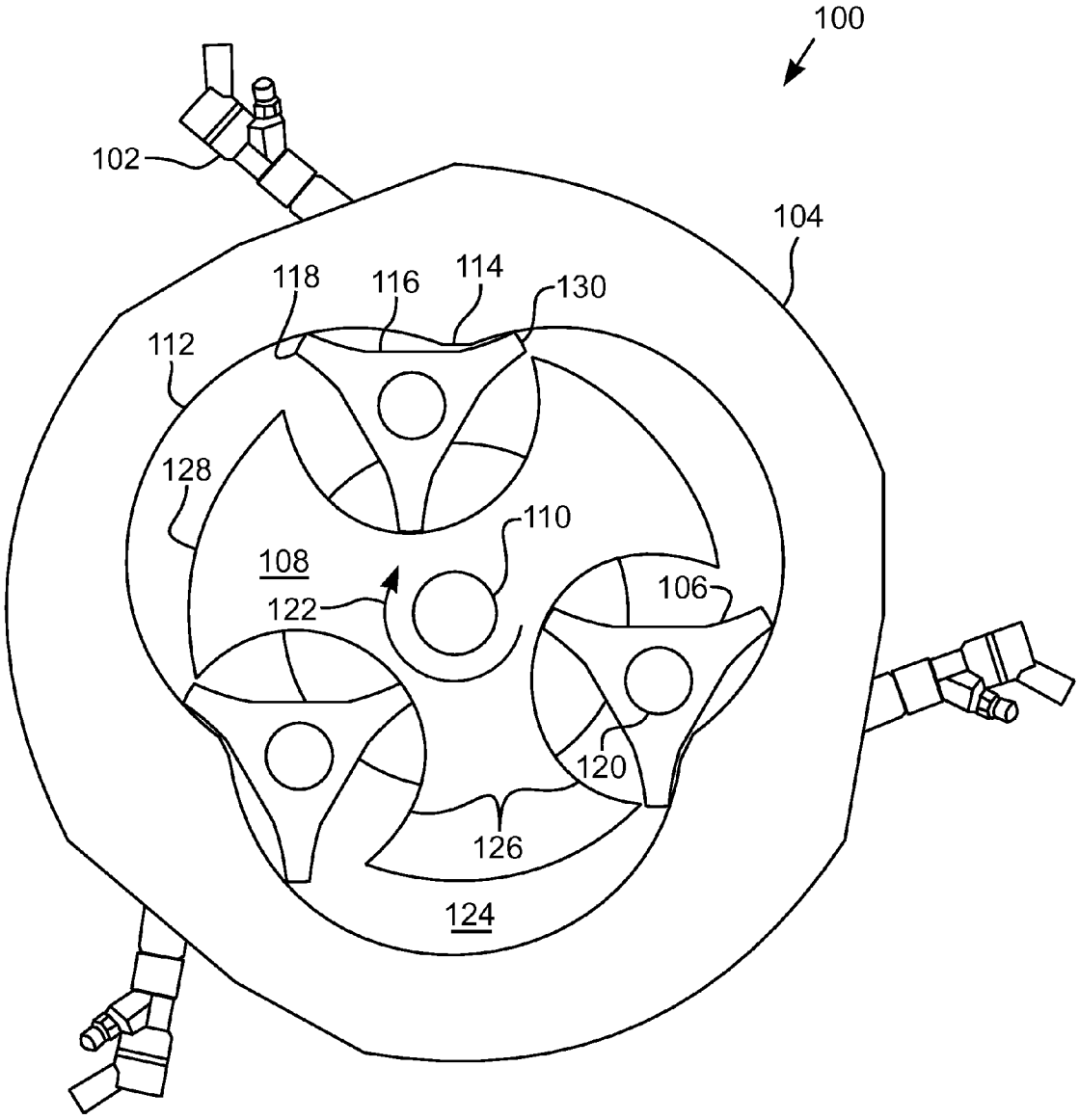
FIG. 1 is an internal view of one embodiment of a rotary internal combustion engine.

FIG. 1 illustrates an internal view of one embodiment of a rotary internal combustion engine 100. The rotary internal combustion engine 100 includes a housing 104, a main rotor 108, and a plurality of planetary rotors 106. The housing 104 has an internal cavity 124 in which rotates the main rotor 108. The main rotor 108 has three cutouts 126 in which the planetary rotors 106 orbit about the main shaft 122.

The internal cavity 124 is defined by three lobes 112. Each pair of adjacent lobes 112 is joined at a bridge 114. The main rotor 108 rotates clockwise 122 on the main shaft 110 inside the housing cavity 124. The main rotor 108 has three circular cutouts 126 that each contain one planetary rotor 106. The main rotor 108 also has three sections of outer rim 128 that engage the bridge 114 during selected positions of the main rotor 108 as the rotor 108 rotates inside the cavity 124.

The planetary rotors 106 have three tips 130. The surface between adjacent tips define a face 116 of the planetary rotor 106. The planetary rotors 106 orbit in the clockwise direction 122 around the main shaft 110 inside the cutouts 126 of the main rotor 108. As the planetary rotors 106 orbit, the rotors 106 do not rotate about their shaft 120, but maintain a stationary position. That is, the face 116 of the planetary rotor 106 that faces upwards in FIG. 1, remains facing upward as the planetary rotor 106 orbits the main shaft 110. The main shaft 110 and the planetary rotor shafts 120 are connected to a planetary gear assembly (not illustrated) that maintains the orbital position of the planetary rotors 106 as they orbit the main shaft 110.

In the illustrated embodiment, the rotary internal combustion engine 100 has three fuel injectors 102, one for each lobe 112. In one such embodiment, the fuel injectors 102 are part of a high-pressure common rail direct injection system that provides fuel for combustion in the engine 100. In other embodiments, the rotary internal combustion engine 100 receives fuel delivered through low pressure fuel injectors, from a carburetor, or by port injection. In various embodiments, fuel ignition occurs through compression or spark plug ignition. The fuel for the rotary internal combustion engine 100 ranges, in various embodiments, from heavy fuels to gasoline to ethanol to various flammable gases, for example, hydrogen gas.

Figure 2:
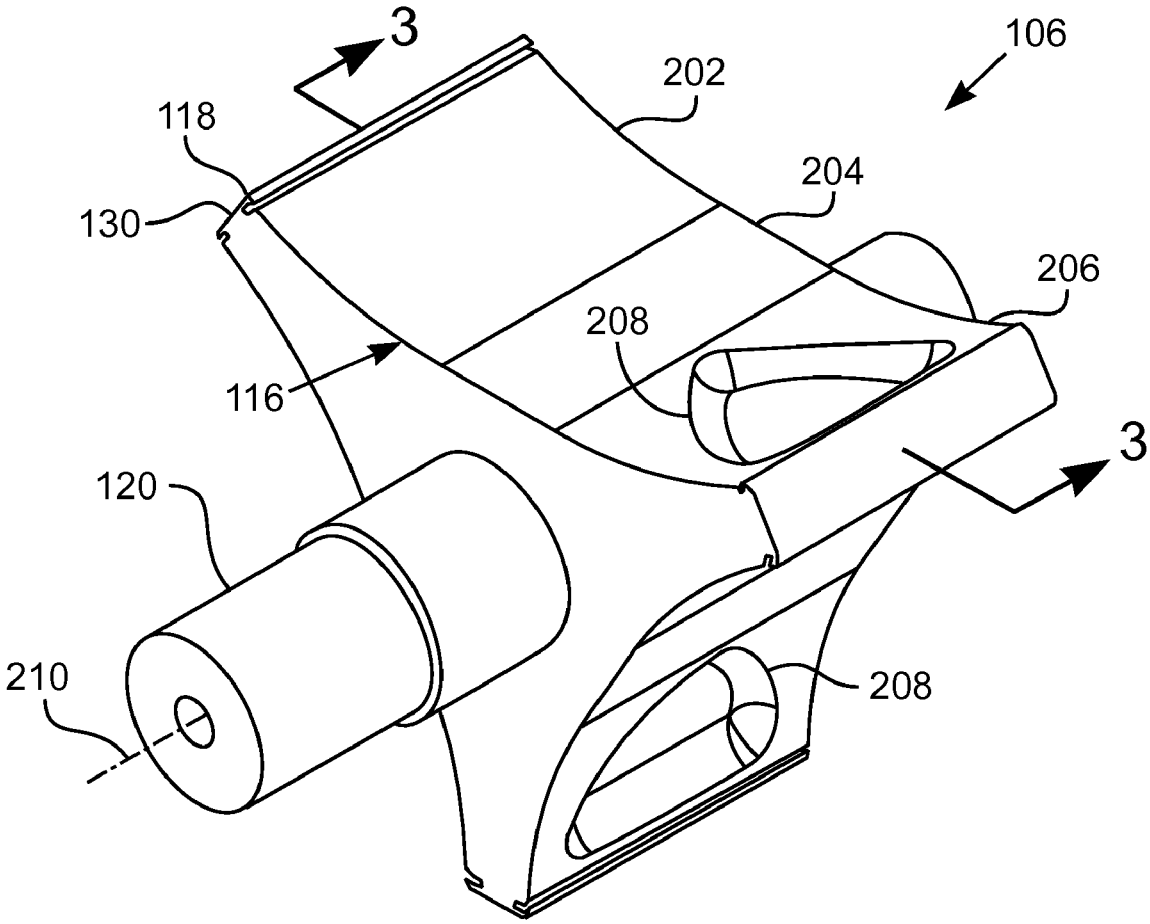
FIG. 2 is a perspective view of one embodiment of a planetary rotor.
Figure 3A:
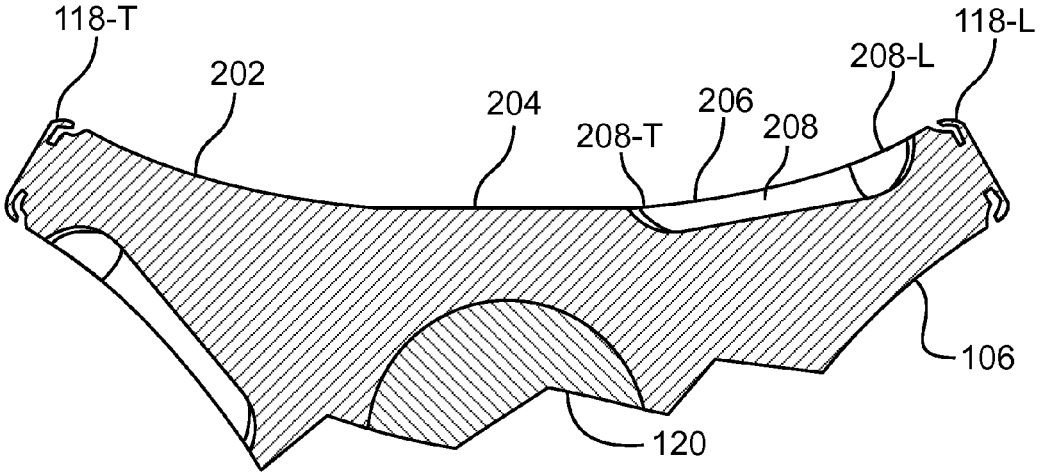
FIG. 3A is a partial cross-sectional view of a planetary rotor.

FIG. 2 illustrates a perspective view of one embodiment of a planetary rotor 106. FIG. 3A illustrates a partial cross-sectional view of the planetary rotor 106. The planetary rotor 106 includes a rotor shaft 120 with a center axis 210. Positioned equidistant from the center axis 210 of the planetary rotor 106 are three faces 116. The planetary rotor 106 has three faces 116 that sequentially engage the lobes 112 of the housing 104. As each face 116 engages successive lobes 112, the face 116 sequentially plays a role in the cycle of intake, compression, combustion, and exhaust. Each face 116 is a multi-faceted face 202, 204, 206 that engages a bridge 114 during the transition from the compression cycle to the combustion cycle with the bridge 444 114 and face 116 forming a dynamic seal. In the illustrated embodiment, each face 116 includes a center section 204 that is flanked on each side by an arcuate surface 202, 206. The arcuate surfaces 202, 206 extend to the tip seals 118. Considering the direction 122 that the planetary rotors 106 orbit, one arcuate surface 202 is the trailing surface 202 and the other arcuate surface 206 is the leading surface 206 of each face 116.

In the illustrated embodiment, the face 116 of the planetary rotor 106 that is opposite the fuel injector 102 when fuel is injected has a pocket 208. In this way, the fuel cloud is able to expand without impinging or wetting the face 116 of the planetary rotor 106. The leading surface 206 includes a depression, or combustion pocket, 208. In the illustrated embodiment, the combustion pocket 208 has a triangular configuration with rounded corners when seen in a top view of the face 116. In other embodiments, the combustion pocket 208 is positioned so as to accommodate the position of the planetary rotor 106 when firing or ignition of the fuel is desired. For example, the trailing corner of the pocket 208 is positioned in the center section 204 to accommodate a fuel injector nozzle 302 at a position closer to the center of the bridge 114 than illustrated in FIG. 3B.

In one embodiment, the center section 204 of the face 116 is a flat surface. In one such embodiment, the flat surface of the center section 204 is parallel to the flat surface of the bridge 114 as the planetary rotor 106 orbits within the cavity 124. In other embodiments, the center section 204 of the face 116 includes one or more curved surfaces. In one such embodiment, the surface of the center section 204 has a large radius such that the gap between the bridge 114 and the center section 204 is substantially constant as the planetary rotor 106 orbits past the bridge 114.

Figure 3B:
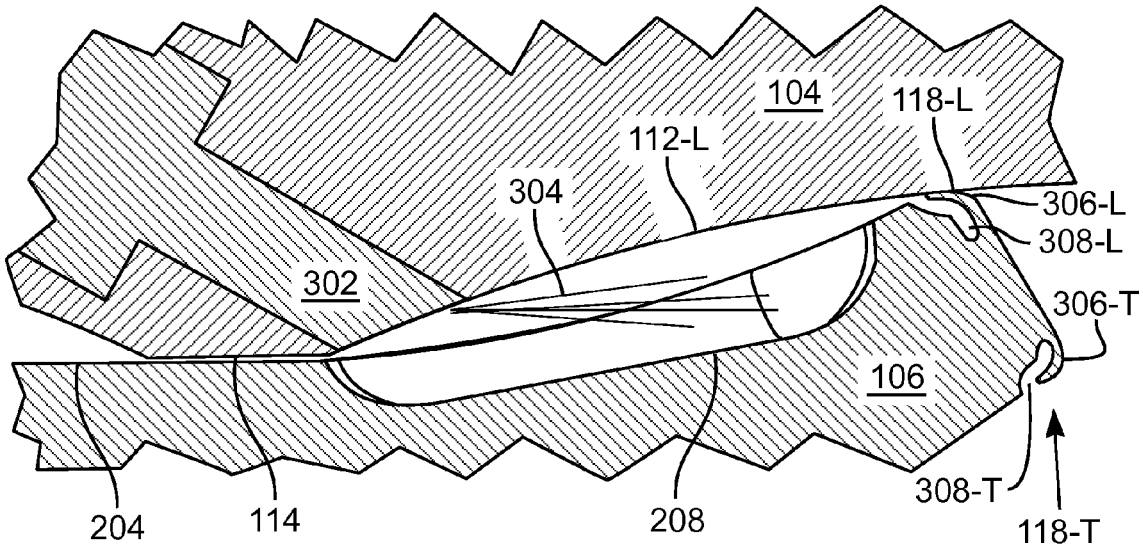
FIG. 3B is a partial cross-sectional view of a planetary rotor and a portion of the housing adjacent the pocket.

FIG. 3B illustrates a partial cross-sectional view of a planetary rotor 106 and a portion of the housing 104 adjacent the pocket 208. Each fuel injector 102 terminates in a fuel injector nozzle 302 that has an end that is flush mounted in the housing 104. The nozzle 302 directs a fan-shaped fuel cloud 304 into the space defined by the leading surface of the lobe 112-L and the inside of the combustion pocket 208. The pocket 208 provides a volume for the fuel cloud 304 to atomize without the fuel cloud 304 impinging on or wetting the surface of the planetary rotor face 116 or the surface of the lobe 112-L.

In the illustrated embodiment, the combustion pocket 208 is deep at the leading end 208-L to accommodate the expanding fuel cloud 304. The pocket 208 is shallow at the trailing end 208-T to minimize the volume of the combustion chamber while still allowing space for the fuel cloud 304 as the planetary rotor 106 orbits. The planetary rotor 106, and the pocket 208, move relative to the fuel injector nozzle 302 as the rotor 106 orbits. The triangular outline of the pocket 208, as seen on the arcuate surface 206 of the planetary rotor face 116, accommodates the fan-shaped fuel cloud 304, which is narrowest and thinnest where the fuel exits the nozzle 302. The shape and location of the pocket 208 is related to the location and position of the fuel injector nozzle 302, as well as the direction and shape of the fuel cloud 304 from the nozzle 304.

One embodiment of the tip seals 118 are identified in FIG. 3B as a leading seal 118-L and a trailing seal 118-T, considering the direction that the planetary rotor 106 orbits in the cavity 124. The leading seal 118-L slides along the lobe 112 such that the direction of relative travel of the surface of the lobe 112 is toward the trailing seal 118-T. That is, the leading seal 118-L, as illustrated in FIG. 3B, is pushed along the surface of the lobe 112. The trailing seal 118-T slides along the lobe 112 such that the direction of relative travel of the surface of the lobe 112 is away from the leading seal 118-L. That is, the trailing seal 118-T is pulled across the surface of the lobe 112.

The leading seal 118-L has a deeper throat, or gap, 308-L than the throat, or gap, 308-T of the trailing seal 118-T. Accordingly, the leading tab 306-L is longer than the trailing tab 306-T. The longer leading tab 306-L and deeper gap 308-L allows the tab 306-L to flex or deform at a position close to the center of the tip of the planetary rotor 106. The shorter trailing tab 306-T and the shallower gap 308-T allows the tab 306-T to flex or deform at a position closer to the corner of the tip of the planetary rotor 106.

The pushing of the leading seal 118-L has a tendency to cause the leading tab 306-L to flex or deform without undue stress on the tab 306-L. That is, the leading seal 118-L moving along the lobe 112 tends to push or force the tab 306-L toward the planetary rotor 106, thereby tending to close the gap 308-L. The pulling of the shorter trailing seal 118-T has a tendency to push or force the trailing tab 306-T away from the planetary rotor 106, which, if the trailing tab 306-T were longer, would result in a longer lever arm and greater stress on the connection of the trailing tab 306-T to the planetary rotor 106.

In the illustrated embodiment, the tip seal 118 of the planetary rotor 106 includes a tab 306 that is separated from the body of the rotor 106 by a gap 308. The tab 306 resiliently moves when the tab 306 contacts a lobe 112. When the planetary rotor 106 orbits the main shaft 110, at least one tip seal 118 is in contact with a lobe 112. The resilience of the tab 306 accommodates manufacturing tolerances, thermal expansion, and irregularities in the surface of the lobe 112. The gap 308 is on the side of the tab 306 that is subject to high pressure, for example, when the trailing tip seal 118-T defines a portion of the compression chamber 408 or the leading tip seal 118-L defines a portion of the combustion chamber 410, as illustrated in FIGS. 4 to 18. The high pressure in the gap 308 applies force to the inside surface of the tab 306, thereby pushing the tab 306 away from the gap 308 and against the surface of the lobe 112. The greater the pressure, the greater the force pushing the tab 306 against the surface of the lobe 112 and the better the seal. The outside surface of the tab 306 is rounded to accommodate the various orientations of the surface of the lobe 112 when the lobe 112 is in contact with the tab 306.

FIGS. 4 through 18 illustrate the position of the planetary rotor 106 relative to the housing 104 and bridge 114 as the planetary rotor 106 orbits about the main shaft 110. When the planetary rotor 106 orbits 360 degrees inside the cavity 124, each of the faces 116 is exposed sequentially to intake, compression, combustion, and exhaust. The compression chamber 408 progressively decreases in volume and the combustion chamber 410 increases in volume as the planetary rotor 106 orbits.

The figures illustrate the planetary rotor 106 relative to TDC. Top dead center (TDC) is defined as the position of the planetary rotor 106 where the radial bridge center 404 is aligned, or coincides, with the radial planetary rotor center 402. That is, TDC is the position of the planetary rotor 106 in relation to the bridge 114 where the illustrated lines labeled 402, 404, 408 coincide. In other words, at TDC a line passes through the center of the bridge 114, the center of the planetary rotor 106, and the center of the main rotor 108.

The radial bridge center 404 is illustrated as a line passing through the center of rotation of the main shaft 110 and the center of the bridge 114. The radial planetary rotor center 402 is illustrated as a line passing through the center of rotation of the main shaft 110 and the center axis 210 of the planetary rotor 106. The center 408 of the planetary rotor face 116 is illustrated as a line passing through the center of one face 116 of the planetary rotor 106 and the center axis 210 of the planetary rotor 106. As the planetary rotor 106 orbits, the center 408 of the planetary rotor face 116 approaches the radial bridge center 404 BTDC, coincides with the radial bridge center 404 at TDC, and moves away from radial bridge center 404 ATDC.

Figure 4:
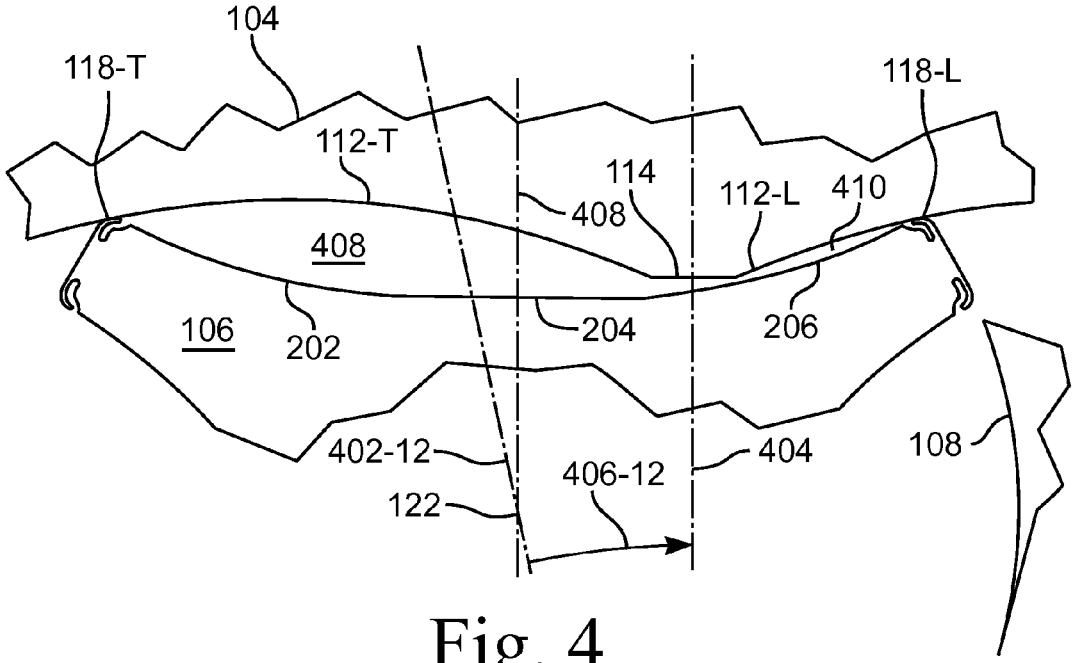
FIG. 4 is a partial front view of the planetary rotor at 12 degrees BTDC.

FIG. 4 illustrates a partial front view of the planetary rotor 106 at 12 degrees BTDC (before top dead center), that is, the radial planetary rotor center 402–12 forms a 12 degree angle 406–12 with the radial bridge center 404.

In the configuration illustrated in FIG. 4, a compression chamber 408 is defined by the surface of the trailing lobe 112-T, the face 116 of the planetary rotor 106, the bridge 114, and one tip seal 118-T. The trailing arcuate surface 202 and the center section 204 of the face 116 of the planetary rotor 106 define one surface of the compression chamber 408. A combustion chamber 410 is defined by the surface of the leading lobe 112-L, the leading arcuate surface 206 of the face 116 of the planetary rotor 106, and one tip seal 118-L.

Compressed gas flows from the compression chamber 408 to the combustion chamber 410 through the slot, or gap, between the bridge 114 and the face 116 of the planetary rotor 106. The gap between the bridge 114 and the leading arcuate surface 206 of the face 116 also includes a portion of the combustion pocket 208.

Figure 5:
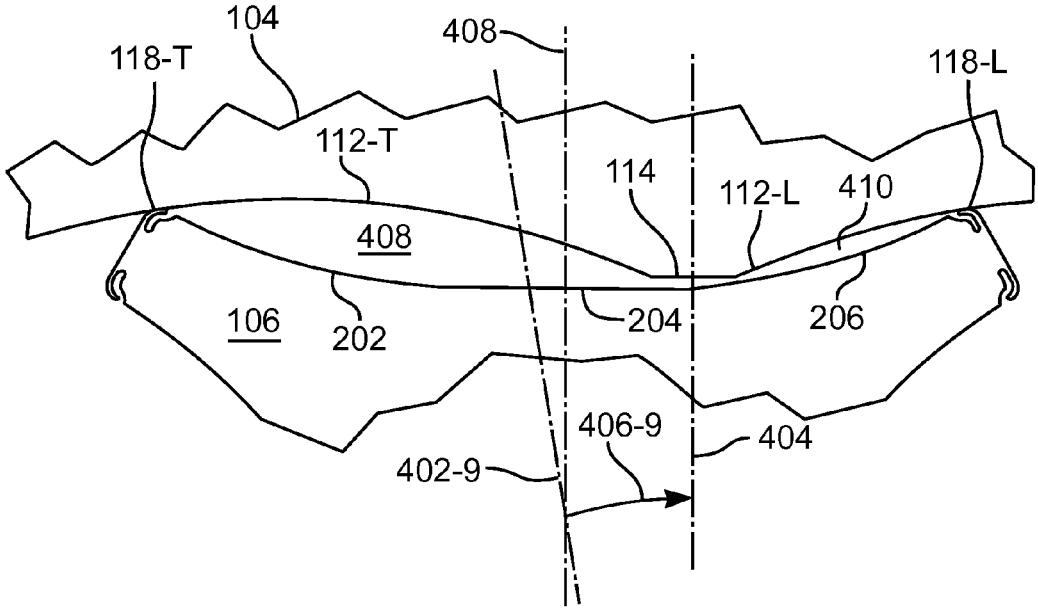
FIG. 5 is a partial front view of the planetary rotor at 9 degrees BTDC.

FIG. 5 illustrates a partial front view of the planetary rotor 106 at 9 degrees BTDC, that is, the radial planetary rotor center 402–9 forms a 9 degree angle 406–9 with the radial bridge center 404. The distance between the center 408 of the planetary rotor face 116 and the radial bridge center 404 is less than that illustrated in FIG. 4 as the planetary rotor 106 continues in its orbit and approaches TDC.

The compression chamber 408 is defined by the surface of the trailing lobe 112-T, the face 116 of the planetary rotor 106, the bridge 114, and one tip seal 118-T. The compression chamber 408 continues decreasing in volume while the combustion chamber 410 increases in volume. Compressed gas continues to flow from the compression chamber 408 to the combustion chamber 410 through the slot, or gap, between the bridge 114 and the face 116 of the planetary rotor 106. The gap between the bridge 114 and the leading arcuate surface 206 of the face 116 also includes a decreasing portion of the combustion pocket 208. The flow from the compression chamber 408 to the combustion chamber 410, because of the slot and combustion pocket 208, causes turbulent flow in the combustion chamber 410.

Figure 6:
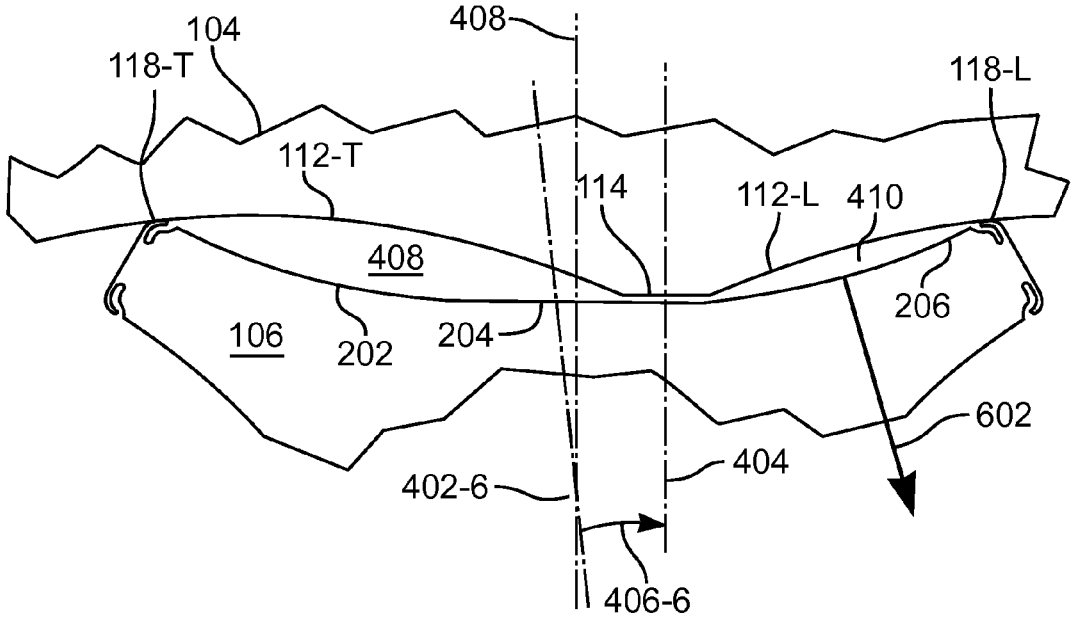
FIG. 6 is a partial front view of the planetary rotor at 6 degrees BTDC.

FIG. 6 illustrates a partial front view of the planetary rotor 106 at 6 degrees BTDC, that is, the radial planetary rotor center 402–6 forms a 6 degree angle 406–6 with the radial bridge center 404. The distance between the center 408 of the planetary rotor face 116 and the radial bridge center 404 continues to decrease as the planetary rotor 106 continues in its orbit and approaches TDC.

The compression chamber 408 is now defined by the surface of the trailing lobe 112-T, the face 116 of the planetary rotor 106, and one tip seal 118-T. The compression chamber 408 continues decreasing in volume while the combustion chamber 410 increases in volume.

The center section 204 of the face 116 of the planetary rotor 106 moves adjacent to the surface of the bridge 114. In the illustrated embodiment, the center section 204 is parallel with the surface of bridge 114. Without combustion in the combustion chamber 410, compressed gas continues to flow from the compression chamber 408 to the combustion chamber 410 through the slot, or gap, between the bridge 114 and the face 116 of the planetary rotor 106. The gap between the bridge 114 and the leading arcuate surface 206 of the face 116 also includes a small portion of the combustion pocket 208. The flow from the compression chamber 408 to the combustion chamber 410, because of the slot and combustion pocket 208, continues to cause turbulent flow in the combustion chamber 410.

Injection and combustion of fuel is based on various factors. In a reciprocating piston engine, a negative torque is generated when fuel is combusted before TDC. In the illustrated embodiment, a positive torque is generated when combustion occurs in the combustion chamber 410 with the planetary rotor 106 approaching TDC. Although the illustrated embodiment shows the planetary rotor 106 at the six degrees BTDC position, combustion can be initiated at other positions of the planetary rotor 106, depending upon engine requirements and power needs. The combustion of the fuel in the combustion chamber 410 causes a force to be applied to the face 116 of the planetary rotor 106. That force is represented by the illustrated force vector 602. The force vector 602 on the planetary rotor 106 is aligned generally with the direction 122 of rotation of the main rotor 108 and the direction of orbit of the planetary rotor 106. That is, the moment arm created by the force vector 602 serves to move the main rotor 108 in the direction 122 of rotation.

In one embodiment, the fuel is introduced initially into the combustion chamber 410 with a short burst from the fuel injector 102 at around six degrees BTDC. The initial burst of fuel from the fuel injector 102 is followed by other bursts of fuel and, between the bursts, compressed gas from the compression chamber 408 flows into the combustion chamber 410 with jet flow, thereby creating turbulence in the combustion chamber 410 and promoting more efficient combustion of the fuel.

Figure 7:
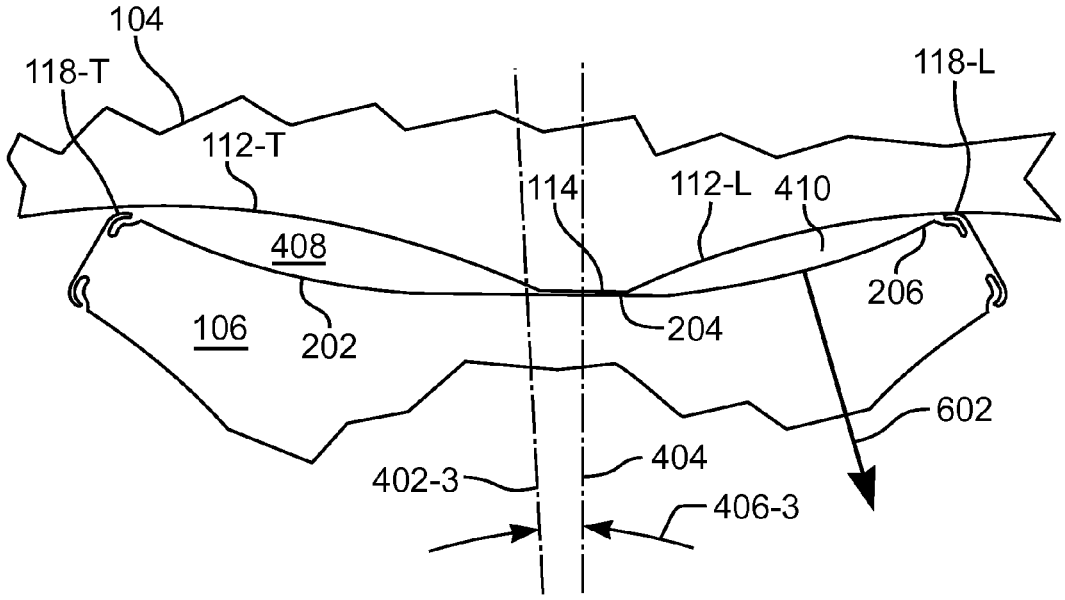
FIG. 7 is a partial front view of the planetary rotor at 3 degrees BTDC.

In other embodiments, the fuel is introduced into the engine 100 by mixing with the intake air, such as with a carburetor. In various embodiments, the fuel mixture is ignited by one or more ignition sources, for example, spark plugs, laser energy, or injection of an externally ignited combustible mass, or by compression of the fuel mixture FIG. 7 illustrates a partial front view of the planetary rotor 106 at 3 degrees BTDC, that is, the radial planetary rotor center 402–3 forms a 3 degree angle 406–3 with the radial bridge center 404. The distance between the center 408 of the planetary rotor face 116 and the radial bridge center 404 continues to decrease as the planetary rotor 106 continues in its orbit and approaches TDC.

The center section 204 of the face 116 of the planetary rotor 106 is aligned with the surface of the bridge 114 and forms a small gap between the center section 204 and the bridge 114. Compressed gas continues to flow from the compression chamber 408 to the combustion chamber 410 through the slot, or gap, between the bridge 114 and the face 116 of the planetary rotor 106. The flow of compressed gas from the compression chamber 408 into the combustion chamber 410 continues only as long at the pressure in the compression chamber is greater than that in the combustion chamber 410. After combustion begins, the narrow gap between the center 408 of the planetary rotor face 116 and the radial bridge center 404 is sufficient to quench the flame front and prevents the propagation of the combustion flame from the combustion chamber 410 into the compression chamber 408.

The face 116 of the planetary rotor 106 engages the bridge 114 during the transition from the compression cycle to the combustion cycle such that the bridge 114 and face 116 have a gap that allows gas flow from the trailing volume 408 to the leading volume 410 and the gap is sufficiently small to quench flame propagation from the leading volume 410 to the trailing volume 408. In this way, turbulence is introduced into the leading volume 410 of a rotary engine 100 during the period that the fuel is introduced into the leading volume 410 without encouraging flame propagation from the leading volume 410 to the trailing volume 408.

Figure 8:
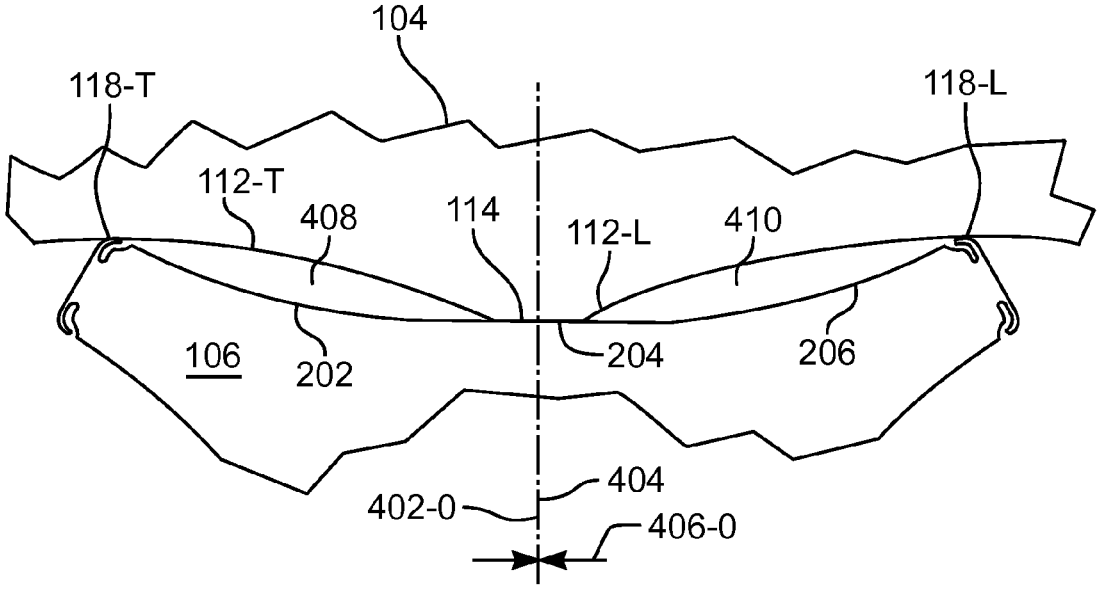
FIG. 8 is a partial front view of the planetary rotor at TDC.

FIG. 8 illustrates a partial front view of the planetary rotor 106 at TDC (top dead center), that is, the radial planetary rotor center 402–0 coincides (forms a 0 degree angle 406–0) with the radial bridge center 404. The surface of the bridge 114 is centered in the center section 204 of the face 116 of the planetary rotor 106. In the illustrated embodiment, the gap between the center section 204 and the bridge 114 is at its smallest size when the planetary rotor 106 is at TDC.

At this position, combustion in the combustion chamber 410 results in a force vector 602 that applies ever greater force/torque for causing the main rotor 108 to rotate.

Figure 9:
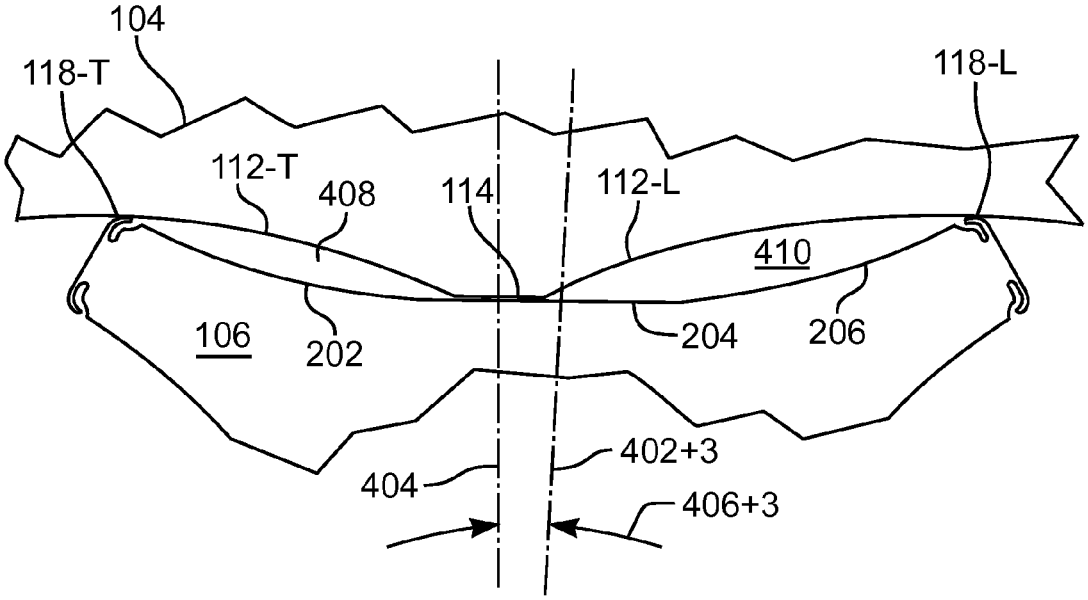
FIG. 9 is a partial front view of the planetary rotor at 3 degrees ATDC.

FIG. 9 illustrates a partial front view of the planetary rotor 106 at 3 degrees ATDC (after top dead center), that is, the radial planetary rotor center 402+3 forms a positive 3 degree angle 406+3 with the radial bridge center 404. The surface of the bridge 114 continues to move along the center surface 204 of the face 116 of the planetary rotor 106 with the gap between the bridge 114 and the face 116 increasing.

Figure 10:
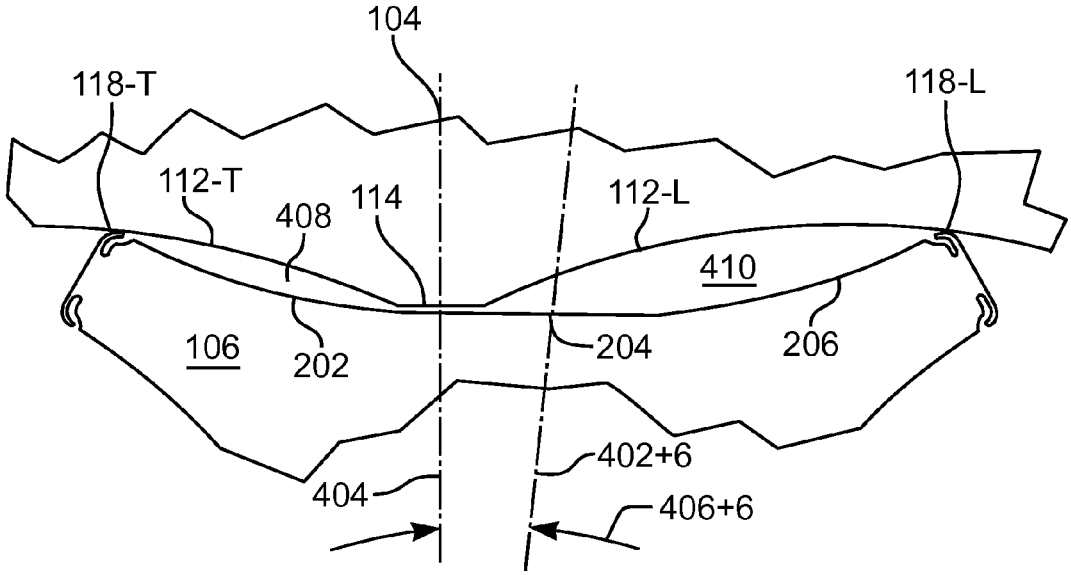
FIG. 10 is a partial front view of the planetary rotor at 6 degrees ATDC.

FIG. 10 illustrates a partial front view of the planetary rotor 106 at 6 degrees ATDC, that is, the radial planetary rotor center 402+6 forms a positive 6 degree angle 406+6 with the radial bridge center 404. The surface of the bridge 114 continues to move along the center surface 204 of the face 116 toward the trailing arcuate surface 202 of the planetary rotor 106. The gap between the bridge 114 and the face 116 continues to increase and the volume of the compression chamber 408 continues to decrease.

Figure 11:
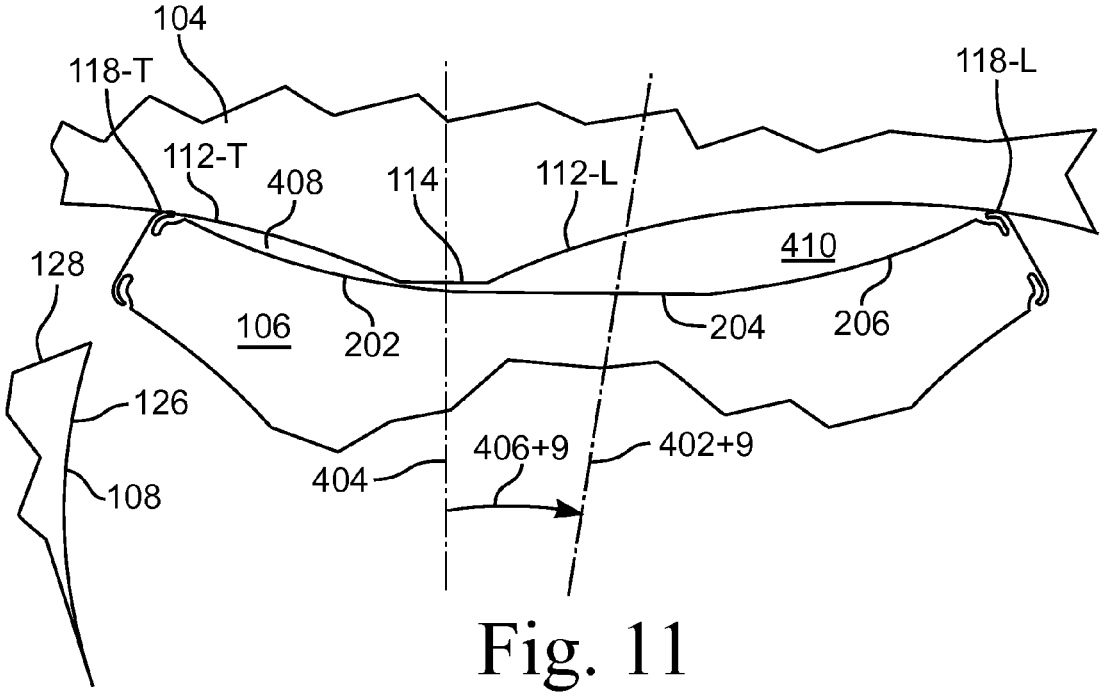
FIG. 11 is a partial front view of the planetary rotor at 9 degrees ATDC.

FIG. 11 illustrates a partial front view of the planetary rotor 106 at 9 degrees ATDC, that is, the radial planetary rotor center 402+9 forms a positive 9 degree angle 406+9 with the radial bridge center 404. The bridge 114 begins moving off the center section 204 and along the trailing arcuate surface 202 of the face 116 of the planetary rotor 106.

As the planetary rotor 106 orbits, the main rotor 108 rotates at the same speed. The planetary rotor 106 moves within the circular cutout 126 of the main rotor 108. FIG. 11 illustrates the inside surface of the circular cutout 126 beginning to move toward the trailing tip seal 118-T.

Figure 12:
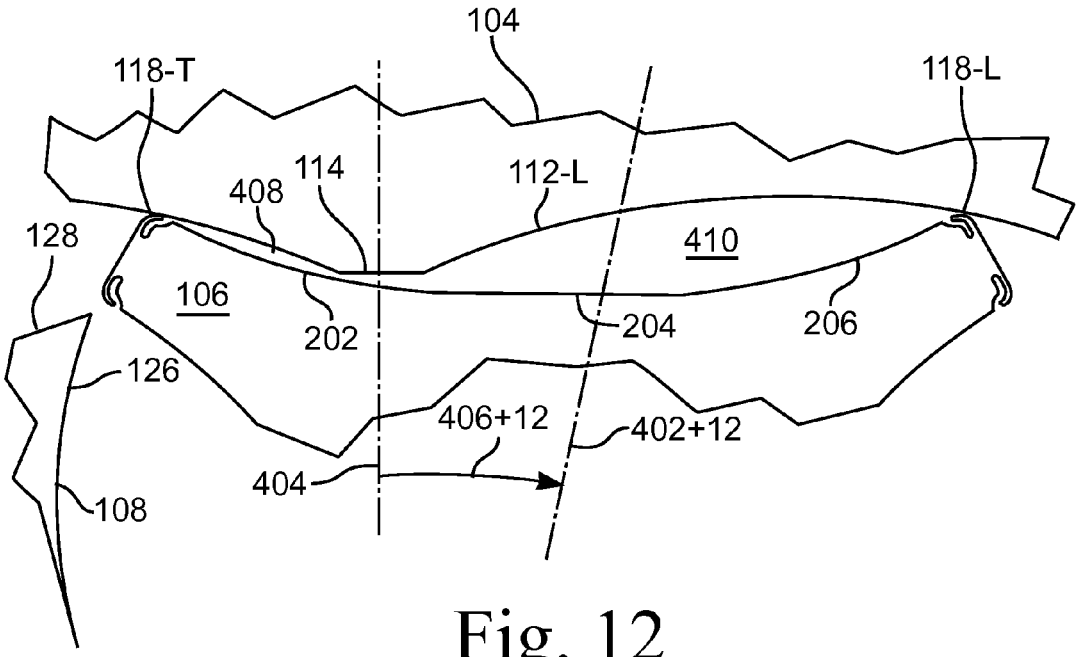
FIG. 12 is a partial front view of the planetary rotor at 12 degrees ATDC.

FIG. 12 illustrates a partial front view of the planetary rotor 106 at 12 degrees ATDC, that is, the radial planetary rotor center 402+12 forms a positive 12 degree angle 406+12 with the radial bridge center 404. The compression chamber 408 has a volume that contains very little gas.

Figure 13:
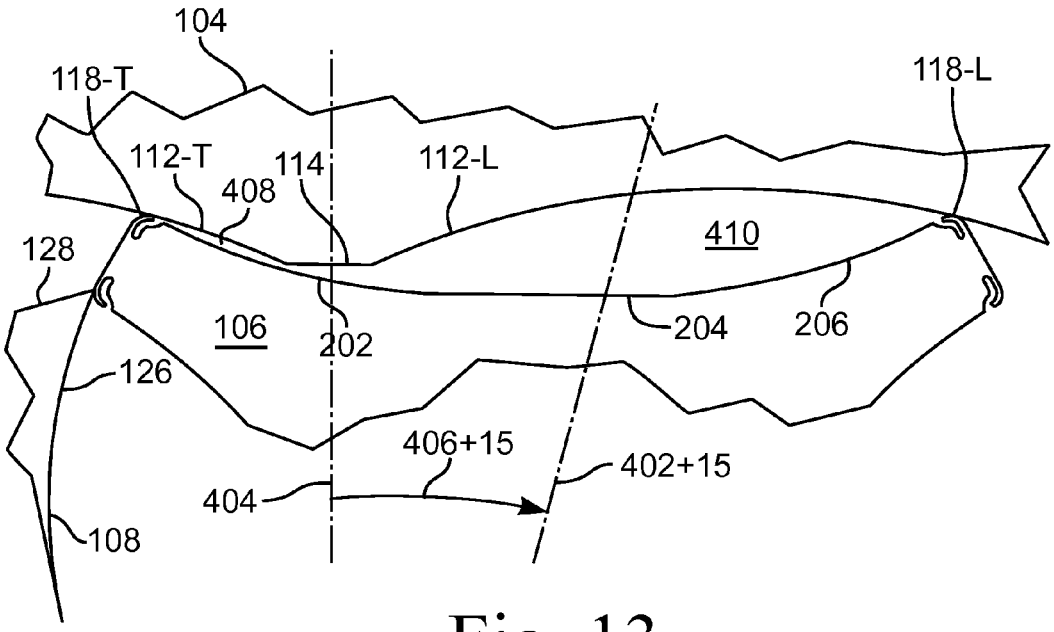
FIG. 13 is a partial front view of the planetary rotor at 15 degrees ATDC.

FIG. 13 illustrates a partial front view of the planetary rotor 106 at 15 degrees ATDC, that is, the radial planetary rotor center 402+15 forms a positive 15 degree angle 406+15 with the radial bridge center 404. The inside surface of the circular cutout 126 begins to move adjacent a tip seal 118.

Figure 14:
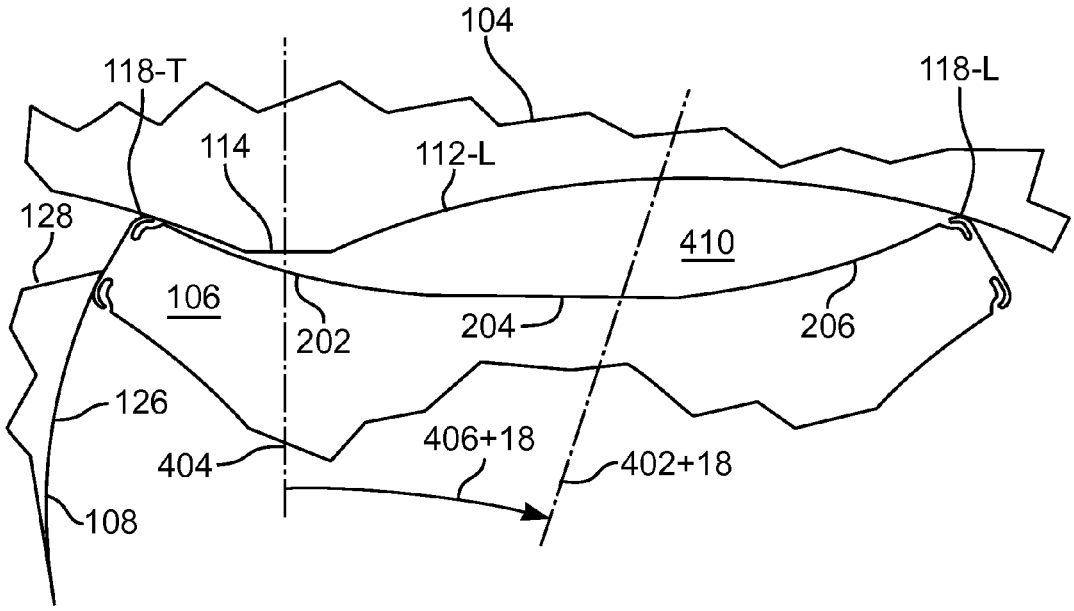
FIG. 14 is a partial front view of the planetary rotor at 18 degrees ATDC.

FIG. 14 illustrates a partial front view of the planetary rotor 106 at 18 degrees ATDC, that is, the radial planetary rotor center 402+18 forms a positive 18 degree angle 406+18 with the radial bridge center 404. The inside surface of the circular cutout 126 begins to move toward the trailing tip seal 118-T and the outer rim 128 of the main rotor 108 approaches the inside surface of the housing 104.

Figure 15:
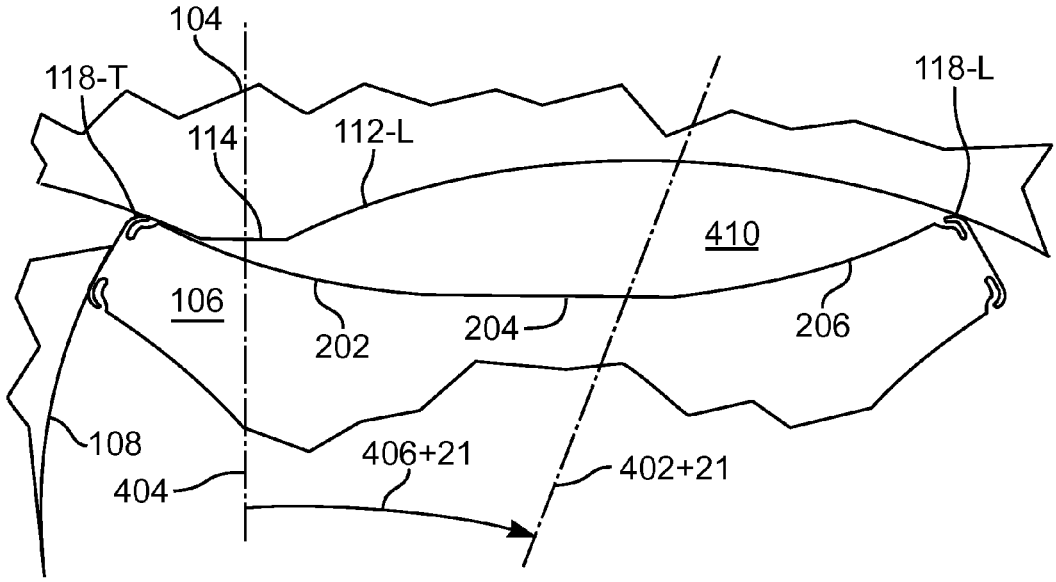
FIG. 15 is a partial front view of the planetary rotor at 21 degrees ATDC.

FIG. 15 illustrates a partial front view of the planetary rotor 106 at 21 degrees ATDC, that is, the radial planetary rotor center 402+21 forms a positive 21 degree angle 406+21 with the radial bridge center 404. The inside surface of the circular cutout 126 begins to move toward the trailing tip seal 118-T and the outer rim 128 of the main rotor 108 approaches the inside surface of the housing 104.

Figure 16:
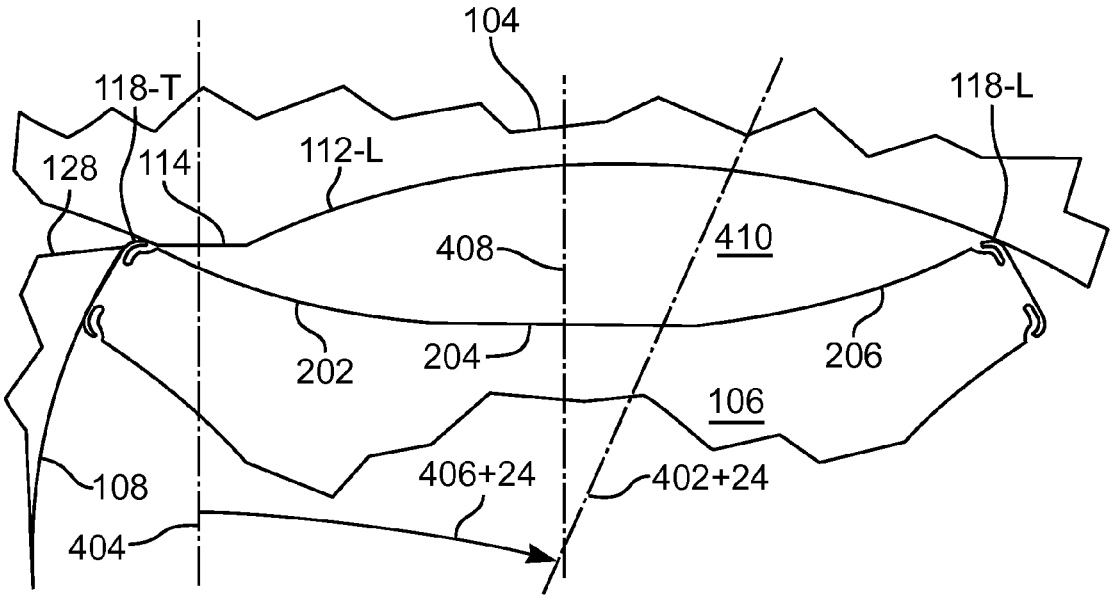
FIG. 16 is a partial front view of the planetary rotor at 24 degrees ATDC.

FIG. 16 illustrates a partial front view of the planetary rotor 106 at 24 degrees ATDC, that is, the radial planetary rotor center 402+24 forms a positive 24 degree angle 406+24 with the radial bridge center 404. The outer rim 128 of the main rotor 108 approaches the bridge 114 and the trailing tip seal 118-T is about to move off of the trailing lobe 112-T.

Figure 17:
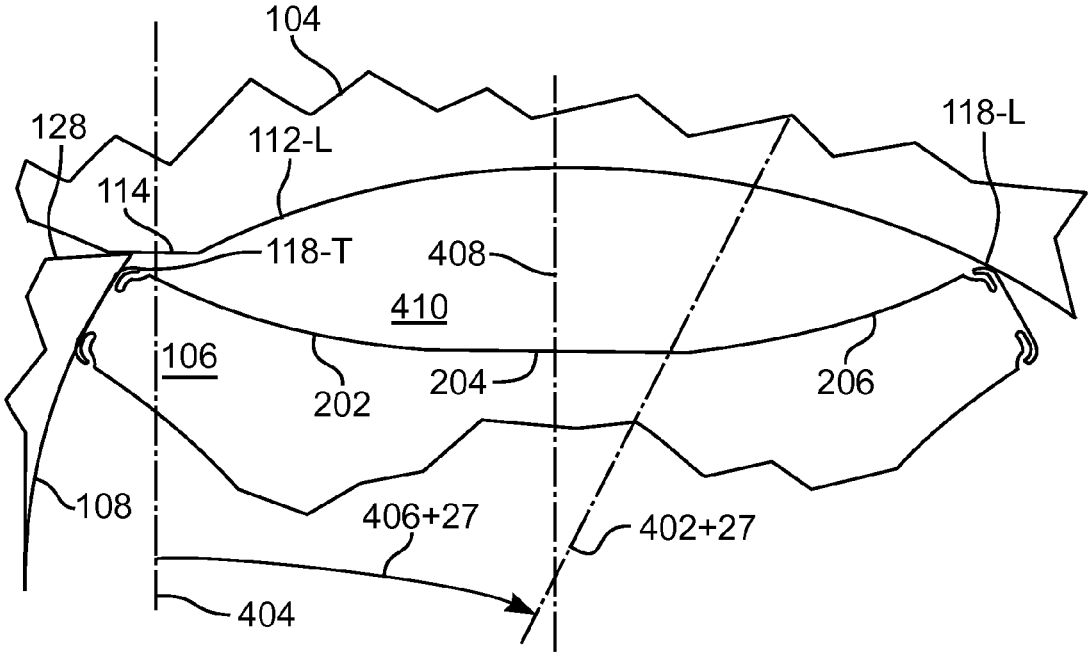
FIG. 17 is a partial front view of the planetary rotor at 27 degrees ATDC.

FIG. 17 illustrates a partial front view of the planetary rotor 106 at 27 degrees ATDC, that is, the radial planetary rotor center 402+27 forms a positive 27 degree angle 406+27 with the radial bridge center 404. The outer rim 128 of the main rotor 108 engages the surface of the bridge 114 and the trailing tip seal of the planetary rotor 106 no longer forms a seal with the inside surface of the housing 104.

In the illustrated embodiment, the outer rim 128 does not contact the surface of the bridge 114, but the outer rim 128 moves past the bridge 114 with a very small air gap between the two surfaces 128, 114. The gap between the two surfaces 128, 124 is small enough that the pressure of the combustion gases in the combustion chamber 410 is not sufficient to cause an appreciable amount of combustion gases to exit the combustion chamber 410 through the gap.

Figure 18:
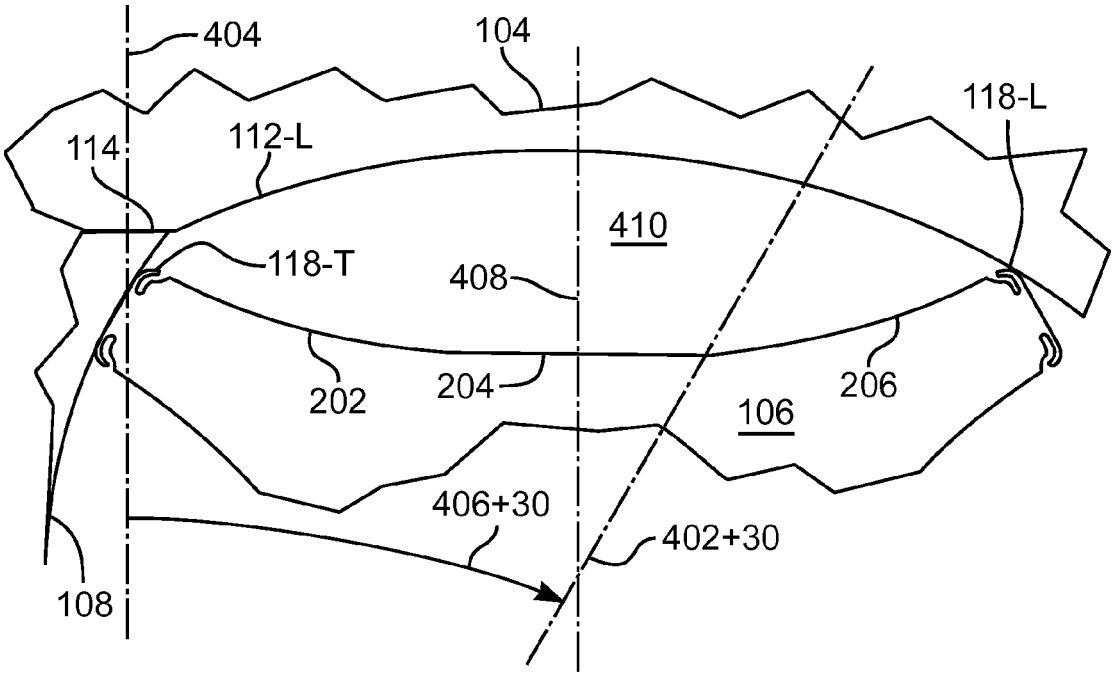
FIG. 18 is a partial front view of the planetary rotor at 30 degrees ATDC.

FIG. 18 illustrates a partial front view of the planetary rotor 106 at 30 degrees ATDC, that is, the radial planetary rotor center 402+30 forms a positive 30 degree angle 406+30 with the radial bridge center 404. The outer rim 128 of the main rotor 108 continues to move past the surface of the bridge 114. The combustion chamber 410 is defined by the surface of the leading lobe 112-L, the face 116 of the planetary rotor 106, one tip seal 118-L, and the inside surface of the circular cutout 126. At this position of the planetary rotor 106 in its orbit, combustion is occurring in the combustion chamber 410 and the combustion gases are expanding.

Figure 19:
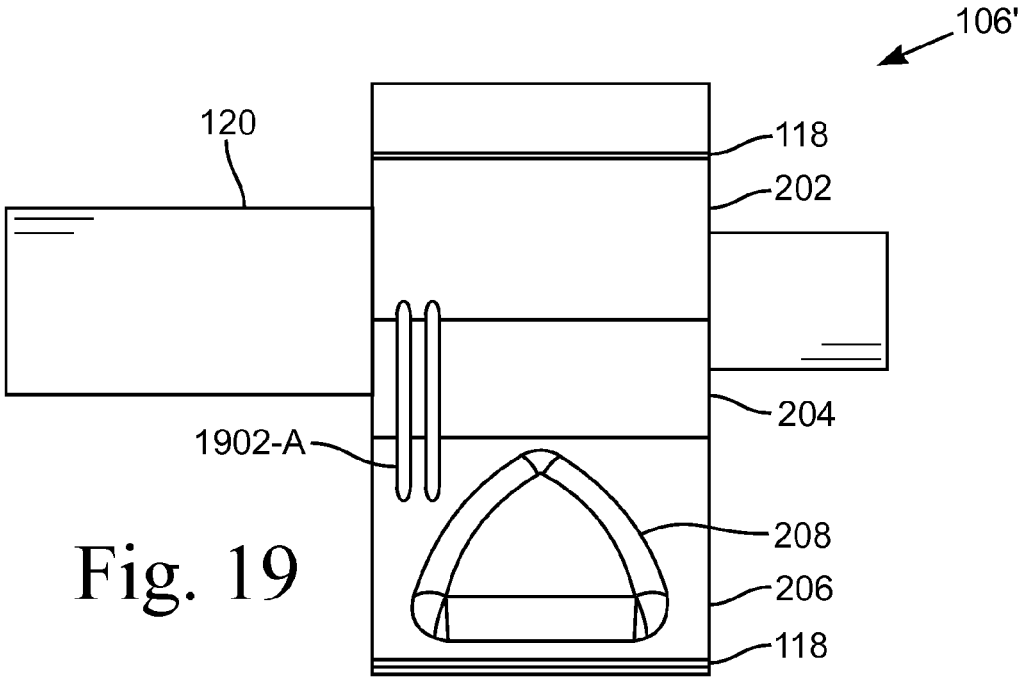
FIG. 19 is a top view of another embodiment of a planetary rotor showing a pair of passages in the face of the rotor.

FIG. 19 illustrates a top view of another embodiment of a planetary rotor 106' showing a pair of passages 1902-A in the face 116. The passages 1902 are grooves in the face 116 of the planetary rotor 106'. When the center section 204 of the face 116 of the planetary rotor 106' is adjacent the bridge 114, such as illustrated in FIGS. 6-10, the passages 1902 provide a path for the compressed gas in the compression chamber 408 to flow into the combustion chamber 410.

In the illustrated embodiment, two passages 1902-A are positioned on one side of the face 116 and connect the trailing arcuate surface 202 with the leading arcuate surface 206 across the center section 204. Because the passages 1902 are positioned asymmetrically, the flow of high pressure gas into the combustion chamber 410 creates turbulence in the combustion chamber 410, which aids in the mixing of the fuel cloud 304 in the combustion chamber 410, which aids in the combustion of that fuel cloud 304. In another embodiment, the passages 1902 connect to the combustion pocket 208. The size, depth, and position of the passages 1902 are determined by the amount and timing of gas flow from the compression chamber 408 to the combustion chamber 410 desired for operation of the engine 100.

The passages 1902-A illustrated in FIG. 19 connect the compression chamber 408 to the combustion chamber 410 by allowing a fluid path between the trailing surface 202 and the leading surface 206 of the face 116 of the planetary rotor 106'. The illustrated configuration may cause combustion gases to flow into the compression chamber 410 if the pressure in the combustion chamber 410 exceeds the pressure of the compression chamber 408. Accordingly, the position of the ends of the passages 1902-A determines the direction of flow along the passages 1902-A.

Figure 20:
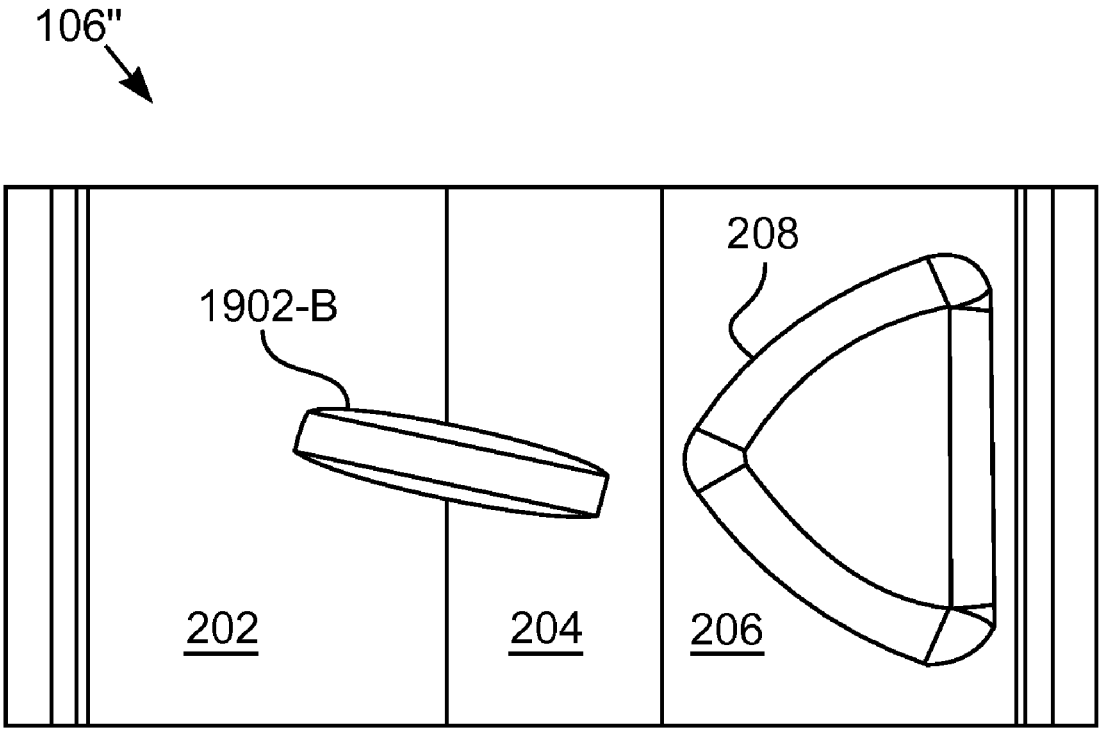
FIG. 20 is a top view of still another embodiment of a planetary rotor showing another embodiment of a passage in the face of the rotor.

FIG. 20 illustrates a top view of still another embodiment of a planetary rotor 106" showing a passage, or groove, 1902-B in the face 116. The position of the passage 1902-B connects the trailing surface 202 and the center section 204 such that, as the planetary rotor 106" orbits past the bridge 114, the pressure in the compression chamber 408 increases until, where the bridge 114 exposes the leading edge of the passage 1902-B the pressure is greater than the pressure in the combustion chamber 410, thereby allowing the gas in the compression chamber 408 to flow into the combustion chamber 410. The angled configuration of the passage 1902-B directs the flow from the compression chamber 408 into the combustion chamber 410 at an angle, thereby aiding in mixing the gas in the combustion chamber 410.

The various components of the rotary internal combustion engine 100 perform various functions. The function of sealing the connection between the planetary rotor 106 and the lobes 112 is implemented, in one embodiment, by the tip seals 118. In one embodiment, the tip seals 118 include a resilient tab 306 that rides against the surface of the lobe 112 to contain compressed gases. Under the tab 306 is a gap 308 that is exposed to high pressure, which forces the tab 306 away from the gap 308 and against the surface of the lobe 112.

The function of sealing the connection between the lobe 112 and the main rotor 108 is implemented, in one embodiment, by the surface of the bridge 114 engaging the outer rim 128 of the main rotor 108, which creates a dynamic seal, not a mechanical seal. The surface of the bridge 114 and the outer rim 128 are separated by a small air gap. The air gap is not sufficiently large to allow an appreciable amount of high pressure gas to flow through the air gap.

The function of creating turbulent flow conditions in the combustion chamber 410 is implemented, in one embodiment, by the bridge 114 engaging the face 116 of the planetary rotor 106, which causes a narrow slot to be formed between the bridge 114 and the face 116. When the pressure in the compression chamber 408 is sufficiently higher than the pressure in the combustion chamber 410, the compressed gas inside the compression chamber 408 flows through the narrow slot into the combustion chamber 410. The jet flow from the narrow slot creates a turbulent condition inside the combustion chamber 410. In another embodiment, passages 1902-A, 1902-B in the face 116 of the planetary rotor 106', 106" allow the compressed gas inside the compression chamber 408 to flow past the bridge 114 into the combustion chamber 410 in an asymmetrical manner, thereby creating turbulence in the combustion chamber 410.

The function of avoiding impingement of fuel is implemented, in one embodiment, by the combustion pocket 208, which is a depression in the face 116 of the planetary rotor 106. The face 116 has a leading surface 206, which is one defining surface of the combustion chamber 410. In one embodiment, the combustion pocket 208 has a triangular shape that corresponds to the fan-shaped fuel cloud 304 emitted by the fuel injector nozzle 302.

From the foregoing description, it will be recognized by those skilled in the art that combustion chamber elements for a rotary internal combustion engine 100 have been provided. The engine 100 includes lobes 112 joined with bridges 114 that protrude into a cavity 124 in the engine housing 104. Inside the cavity 124 is a main rotor 108 that includes circular cutouts 126. Inside each circular cutout 126 is a planetary rotor 106 that has faces 116 positioned about the circumference of the planetary rotor 106. The faces 116, the lobes 112, and the bridges 114 sequentially define a compression chamber 408 and a combustion chamber 410. As combustion proceeds and the main rotor 108 rotates, an outer rim 128 of the main rotor 108 forms a seal with the bridge 114 to further contain the combustion gases.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for facilitating combustion in a rotary engine, said apparatus comprising:

a planetary rotor having a face, said face defining a portion of a combustion chamber, said planetary rotor configured to orbit with a fixed orientation inside a cavity of the rotary engine, a portion of a surface of said cavity defining said combustion chamber;

a pocket extending into said face, said pocket positioned to receive a fuel cloud, said pocket dimensioned to allow said fuel cloud to expand without significantly impinging upon or wetting a surface of said pocket, and said pocket having a substantially triangular configuration at an intersection of said pocket with said face, and an apex of said triangular configuration proximate a center of said face.

2. The apparatus of claim 1 wherein said cavity includes a plurality of lobes, and adjacent ones of said plurality of lobes joined with a bridge protruding into said cavity.

3. The apparatus of claim 1 wherein said cavity includes a plurality of lobes, adjacent ones of said plurality of lobes joined with a bridge protruding into said cavity, and further including a main rotor inside said cavity, said main rotor having at least one circular cutout, said main rotor having a rim that engages said bridge when said rim is adjacent said bridge.

4. The apparatus of claim 1 wherein said face has a first section and a second section, said first section positioned proximate a leading edge of said face, said second section is medial to the face, said second section configured to form a dynamic seal when proximate to a bridge in the rotary engine, said dynamic seal isolating a leading volume defined by said first section and a trailing volume.

5. The apparatus of claim 1 wherein said face has a first section and a second section, said first section positioned proximate a leading edge of said face, said second section is medial to the face, said second section configured to form a gap with a bridge in the rotary engine when proximate to said bridge, said gap allowing gas to flow into a leading volume defined by said first section.

6. The apparatus of claim 1 wherein said face has a first section and a second section, said first section positioned proximate a leading edge of said face, said second section is medial to the face, said second section configured to form a gap with a bridge in the rotary engine when proximate to said bridge, said gap dimensioned to quench flame propagation through said gap.

7. An apparatus for facilitating combustion in a rotary engine, said apparatus comprising:

a cavity having a plurality of lobes, adjacent ones of said plurality of lobes joined at a bridge; and a planetary rotor having a face, said planetary rotor configured to orbit with a inside said cavity, said bridge separating a leading volume from a trailing volume when said bridge is adjacent said face, said face having a first section and a second section, said first section defining said leading volume when said planetary rotor is near a top dead center position, said second section adjacent said bridge when said planetary rotor is near said top dead center position, said second section forming a dynamic seal with said bridge to isolate said leading volume from said trailing volume when said planetary rotor travels through said top dead center position: and a channel through said dynamic seal allowing a compressed gas in said trailing volume to flow into said leading volume, said channel being a groove in said face, said groove having a longitudinal axis that is oblique to a plane perpendicular to an axis of rotation of said planetary rotor.

8. The apparatus of claim 7 further including a main rotor configured to rotate about a main axis inside said cavity, said main rotor having a circular cutout, said planetary rotor received by said circular cutout.

9. The apparatus of claim 7 further including a main rotor configured to rotate about a main axis inside said cavity, said main rotor having a rim that engages said bridge when said rim is adjacent said bridge.

10. The apparatus of claim 7 wherein said channel is a gap between said face and a surface of said bridge, said gap dimensioned to quench any flame propagation through said gap.

11. The apparatus of claim 7 wherein said groove joins said leading volume with said trailing volume.

12. The apparatus of claim 7 wherein said planetary rotor is configured to orbit with a fixed orientation inside said cavity, said fixed orientation requires that said planetary rotor remains stationary on a planetary rotor axis as said planetary rotor orbits in a circular path centered in said cavity.

13. An apparatus for facilitating combustion in a rotary engine, the rotary engine having a cavity with adjacent lobes joined with a bridge protruding into the cavity, a main rotor inside the cavity, the main rotor having at least one circular cutout, the main rotor having a rim that engages the bridge when the rim is adjacent the bridge, a planetary rotor inside the at least one circular cutout, the planetary rotor configured to orbit about the center of rotation of the main rotor, the planetary rotor having a plurality of faces, each one of the plurality of faces and a corresponding bridge defining a leading volume and a trailing volume when the one face engages the corresponding bridge when the planetary rotor orbits in the cavity, said apparatus comprising:

a first section of said face, said first section defining a leading volume when said planetary rotor is at a top dead center position;

a second section of said face, said second section adjacent said bridge when said planetary rotor is at said top dead center position, said second section forming a dynamic seal with said bridge to isolate said leading volume from said trailing volume; and a channel through said dynamic seal allowing a compressed gas in said trailing volume to flow into said leading volume, said channel being a groove in said face, and said groove having a longitudinal axis that is oblique to a plane perpendicular to an axis of rotation of said planetary rotor.

14. The apparatus of claim 13 wherein said channel is a gap between said face and a surface of said bridge, said gap dimensioned to quench any flame propagation through said gap.

15. The apparatus of claim 13 wherein said channel is a groove in said face, said groove joining said leading volume with said trailing volume.

* * * * *